United States Patent [19]

Downing

[11] 4,040,134

[45] Aug. 9, 1977

[54] PONTOON BOAT

[76] Inventor: Alvin Downing, 3939 N. Dayton Lake View Road, New Carlisle, Ohio 45344

[21] Appl. No.: 727,178

[22] Filed: Sept. 27, 1976

[51] Int. Cl.[2] ..... B63B 7/00

[52] U.S. Cl. ..... 9/2 F; 9/2 R; 114/61

[58] Field of Search ..... 114/61; 9/1.1, 1.2, 9/1.6, 2 R, 2 C, 2 F, 2 S

[56] References Cited

U.S. PATENT DOCUMENTS

| | | | |
|---|---|---|---|
| 2,588,084 | 3/1952 | Bushfield | 9/2 R |
| 2,896,831 | 7/1959 | Ellingson | 9/1.6 |
| 3,273,528 | 9/1966 | Kiefer | 114/61 |
| 3,613,136 | 10/1971 | Cogliano | 9/2 S |
| 3,691,572 | 9/1972 | Yannes | 9/2 S |
| 3,738,684 | 6/1973 | Lusk | 9/1.2 |
| 3,763,511 | 10/1973 | Sisil | 9/2 R |
| 3,968,532 | 7/1976 | Bailey | 114/61 |

*Primary Examiner*—Trygve M. Blix
*Assistant Examiner*—D. W. Keen

[57] ABSTRACT

This invention consists primarily of a catamaran type of boat, which includes a main frame upon which is a deck and two standard canoes for use as pontoons. The canoes are converted into pontoons by the addition of light weight cellular floatation material, which makes them virtually unsinkable. The canoes are pivotable between a position along each outer side of the main frame for wide spaced apart support upon the water. The arrangement includes a means whereby the canoe-pontoons are pivoted upward on top of the deck, so as to be out of the way and contracting the pontoon boat width, when being towed as a trailer upon the highway, the underside of the main frame supporting downwardly pivotable wheel assemblies, for travel on the highway surface.

2 Claims, 4 Drawing Figures

PONTOON BOAT

This invention relates generally to catamaran or pontoon type boats.

A principal object of the present invention is to provide a pontoon boat having a relatively wide deck, the pontoon boat being supported upon the water by side spread apart pontoons, so as to minimize boat rolling due to waves, and the pontoons being inwardly pivotable upon the deck, so that the boat is thus made narrower, for being towed as a trailer upon a highway.

Another object of the present invention is to provide a pontoon boat which includes its own retractable and extendible wheel carriages, so as to eliminate the necessity of a separate boat trailer, when being towed on a highway.

Still another object is to provide a pontoon boat, which is quickly and easily adjusted between a towed position and a utility position upon the water.

Other objects are to provide a pontoon boat, which is simple in design, inexpensive to manufacture, rugged in construction, easy to use and efficient in operation.

These and other objects will be readily evident upon a study of the following specification, and the accompanying drawings, wherein.

Figure 1:
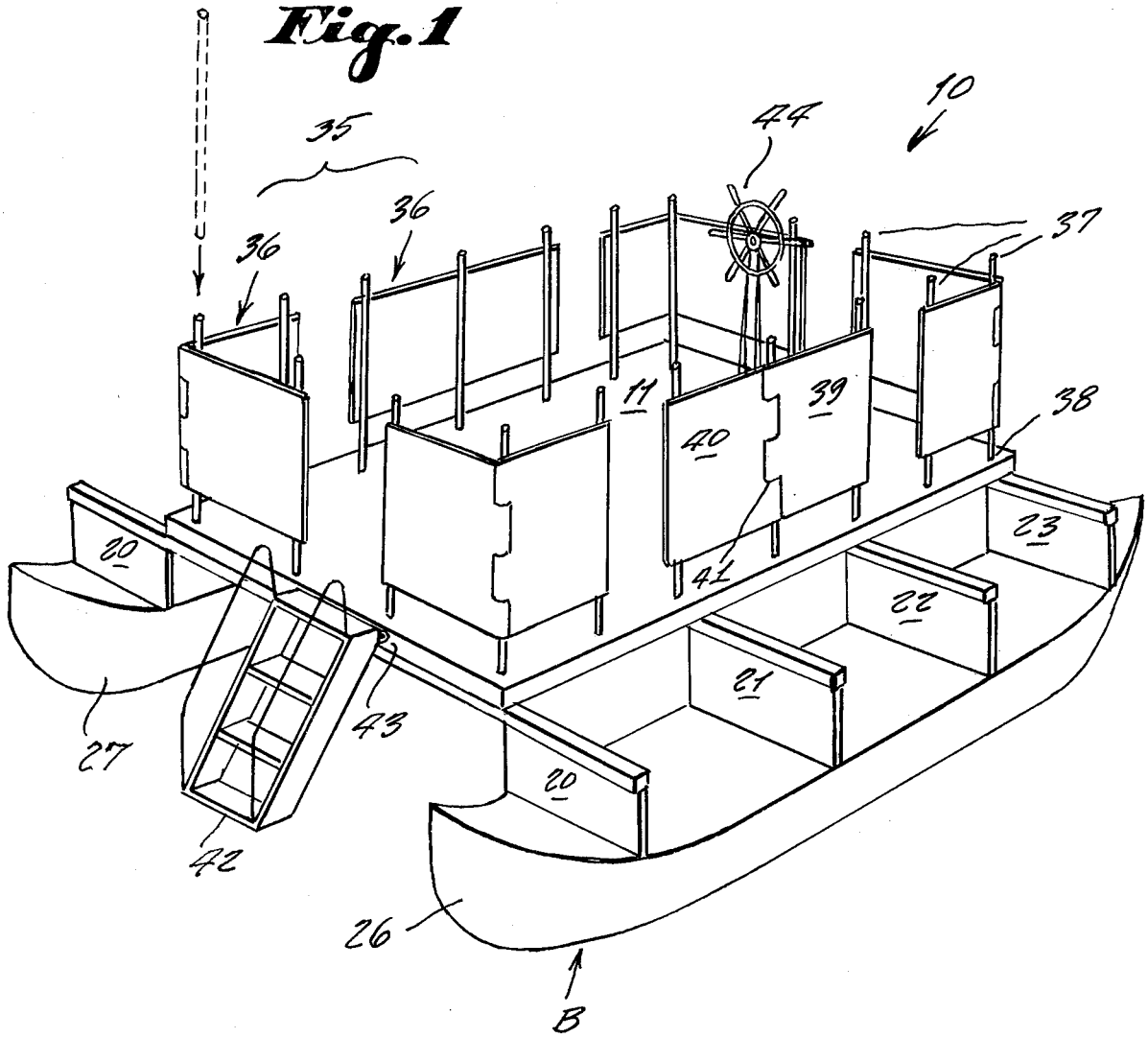
FIG. 1 is a perspective view of the present invention.

Referring now to the drawings in greater detail, the reference numeral 10 represents a pontoon boat, according to the present invention, wherein the same includes a rectangular deck 11, mounted upon a main frame 12, and which includes two longitudinally telescoping tubes 13 and 14, and four transverse telescoping tubes 15, 16, 17 and 18, and which may be locked in their extended position, by the insertion of eight strengtheners 19, one of which is inserted into each end of the transverse tubes.

A set of four mounting frames 20, 21, 22 and 23 are affixed to each outward end of the transverse telescopic tubes 15, 16, 17 and 18, each mounting frame including suitable strengthening cross braces 24 and 25. The four mounting braces on each side are rigidly affixed to a canoe 26 and 27, as shown. The telescoping outward ends of the transverse tubes 15, 16, 17 and 18 include a cut 28, so as to be pivotable about hinges 29, in order that, selectively, the pontoons can be pivoted upwardly, on top of the deck, as shown at A in FIG. 2, or else outwardly pivoted for resting upon the water, as shown at B in FIGS. 1 and 2. In this extended position, the strengtheners 19 bridge the inter-hinged components of the transverse tubes.

Figure 2:
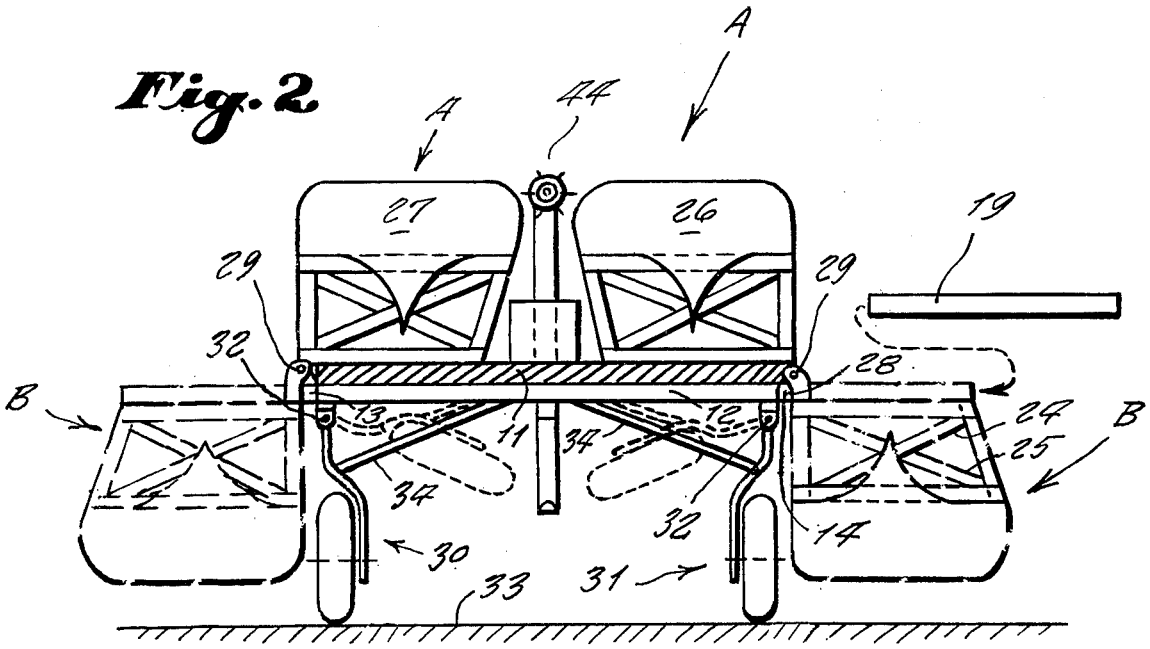
FIG. 2 is an end view thereof, shown in retracted position.
Figure 3:
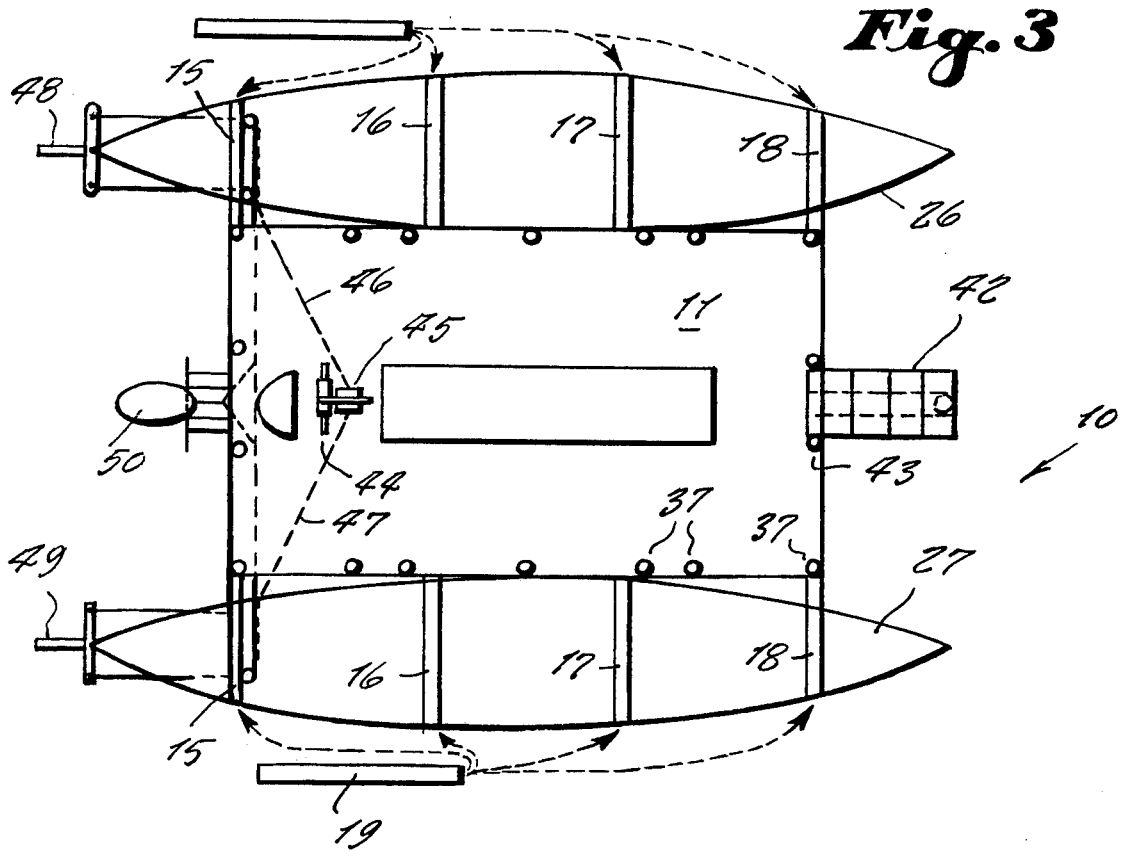
FIG. 3 is a top view thereof, shown in extended position.
Figure 4:
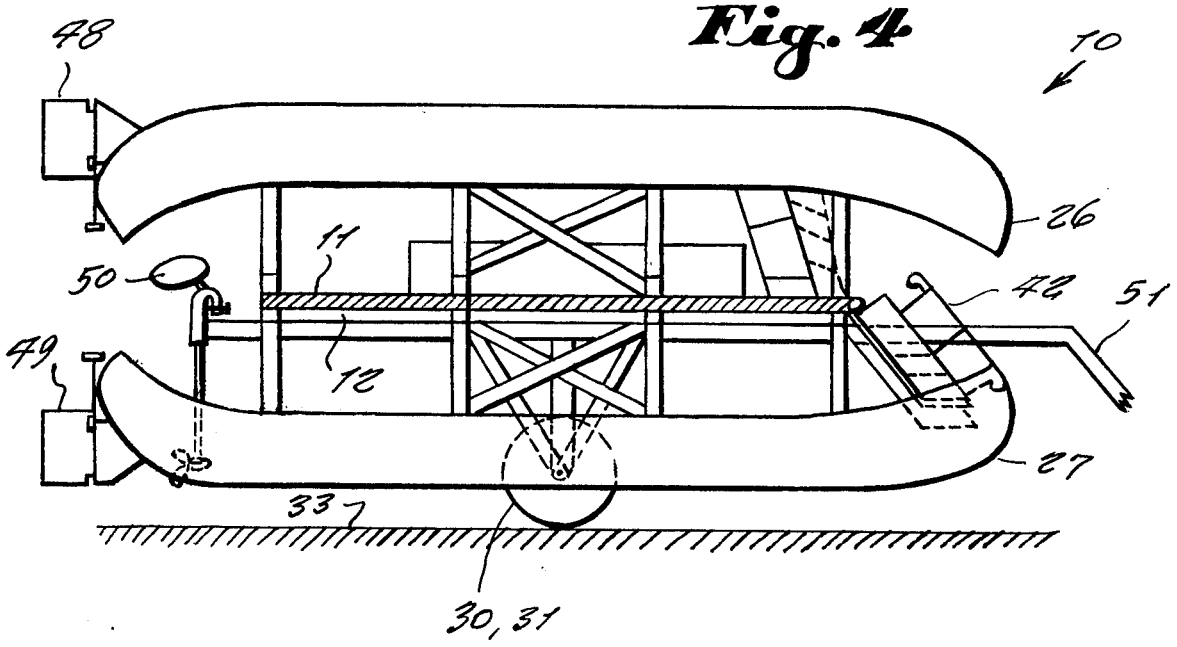
FIG. 4 is a side view thereof.

A pair of wheel assemblies 30 and 31 are each pivotable about a hinge 32, on an underside of the main frame 12, so that the wheel assemblies can be upwardly retracted, as shown by dotted lines in FIG. 2, when not in use, or be downwardly extended, as shown by the solid lines in FIG. 2, in order that the pontoon boat can thus travel as a trailer upon a highway surface 33. Suitable braces 34 retain the wheel assemblies in downward extended positions.

The pontoon boa includes the deck railing 35, for purposes of safety to passengers, the railing being made up of separate sections 36, each of which includes vertical posts 37, removably insertable into receptacle openings 38 formed upon the deck, the posts supporting panels 39 and 40, pivotally together, by means of hinge means 41, formed around a center of a post 37 between two opposite end posts.

A ladder 42, pivotable about a hinge 43, is also included, for providing access to the deck 11 from a boat, or else from a shore.

The pontoon boat can include a helm 44 at one end, and other controls associated therewith, such as a winch 45, and cables 46 and 47 for winding thereupon, the cables controlling rudders 48 and 49, at the rear of the two pontoons. A conventional outboard motor 50 is secured to a rear end of the main frame, and is located close to the helm, so as to be controlled by a helmsman.

A telescoping tongue 51 is forwardly extendible from the main frame 12, for the purpose of attachment to a towing vehicle, when the pontoon boat is transported upon a highway. In the retracted position, the ladder is dropped down over the tongue.

In a preferred size, the pontoon boat will have a deck 6 feet wide and twelve feet long. The pontoons in an extended position will provide a 12 foot width, so as to provide stability against rolling.

Suitable pins, bolts or spring clips will be utilized in the construction, for locking movable parts together, such as the strengtheners to the transverse telescoping tubes, and the like, so that the craft can be thus quickly and easily converted between positions, that can be accomplished by any person without special skills.

It shall also be noted, that the canoes are converted into pontoons by the addition of a suitable light weight cellular flotation materil. After the canoes are completely filled, (level with the gunwales) covers are attached of the same material as the hulls of the canoes, in a water tight manner that will be strong enough to be used as decks thereon.

While various changes may be made in the detail construction, it is understood that such changes will be within the spirit and scope of the present invention as is defined by the appended claims.

What I claim is:

1. A pontoon boat, comprising in combination, a rectangular main frame having a deck thereupon, said main frame including a pair of longitudinally telescopic tubes and a plurality of four transverse telescoping tubes, said transverse telescoping tubes being sidewardly extendible beyond a side edge of said main frame, outward extended sections of said transverse telescoping tubes each being secured to a mounting frame, said mounting frame being secured to two pontoons, each of which is made of a standard canoe, and said pontoons consisting of said canoes being filled with a suitable light weight and cellular flotation material, said canoes being covered so as to be watertight and serving as a strong decking, each said outward section of said transverse telescoping tubes being hingedly pivotable, so that said pontoons are pivotable between a position along each side of said main frame and a position upon said deck; a strengthener being insertable into each of said transverse telescoping tubes for bridging said hinge, in order to rigidly lock said outward section thereof to a remainder of said transverse telescoping tube; a pair of wheel assemblies pivotally attached to an underside of said main frame for being upwardly retracted out of the way, or in a downwardly extended position for travel upon a highway, said wheel assemblies in downward extended position being secured by braces; said pontoon boat including a forwardly telescoping tongue for attachment to a towing vehicle, said pontoon boat including a forwardly pivotable ladder secured by a hinge to a forward edge of said deck; and a removeable rail around a periphery of said deck being comprised of a plurality of railing sections spaced apart end to end, each one of said railing sections being comprised of three vertical posts and a pair of panels, both of which are supported pivotally by hinge means from a center of said posts.

2. The combination as set forth in claim 1, wherein a helm is provided upon said deck, said helm controlling a rudder at a rear of each of said pontoons, and said pontoon boat also including an outboard motor with controls for operation by a helmsman at said helm.

* * * * *